US009030175B2

(12) United States Patent
Wrede

(10) Patent No.: US 9,030,175 B2
(45) Date of Patent: May 12, 2015

(54) TAP CHANGER WITH VACUUM SWITCH TUBES

(75) Inventor: Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 164 days.

(21) Appl. No.: 13/390,402

(22) PCT Filed: Jun. 12, 2010

(86) PCT No.: PCT/EP2010/003554

§ 371 (c)(1),
(2), (4) Date: Feb. 16, 2012

(87) PCT Pub. No.: WO2011/035825

PCT Pub. Date: Mar. 31, 2011

(65) Prior Publication Data

US 2012/0139510 A1 Jun. 7, 2012

(30) Foreign Application Priority Data

Sep. 26, 2009 (DE) ..... 10 2009 043 171

(51) Int. Cl.

| | |
|---|---|
| ***G05F 1/16*** | (2006.01) |
| ***H01H 9/00*** | (2006.01) |
| ***G05F 1/10*** | (2006.01) |

(52) U.S. Cl.

CPC ..... *H01H 9/0027* (2013.01); *G05F 1/10* (2013.01); *H01H 9/0038* (2013.01)

(58) Field of Classification Search

USPC ..... 323/258; 200/330, 560, 6 R, 11 A, 200/11 TC, 284, 400

See application file for complete search history.

(56) References Cited

U.S. PATENT DOCUMENTS

| | | | | | |
|---|---|---|---|---|---|
| 3,467,800 | A | * | 9/1969 | Barr | 200/469 |
| 3,935,407 | A | * | 1/1976 | Bleibtreu et al. | 218/120 |
| 5,488,212 | A | * | 1/1996 | Fukushi et al. | 200/400 |
| 5,594,223 | A | * | 1/1997 | Fukushi et al. | 200/400 |
| 5,834,717 | A | * | 11/1998 | Neumeyer et al. | 200/17 R |
| 6,060,669 | A | * | 5/2000 | Dohnal et al. | 200/11 TC |
| 7,545,245 | B2 | * | 6/2009 | Zhou et al. | 200/400 |

FOREIGN PATENT DOCUMENTS

| | | | | |
|---|---|---|---|---|
| DE | 4231353 | A | | 4/1993 |
| GB | 1293060 | B | | 10/1972 |
| JP | 55117212 | A | * | 9/1980 |
| JP | 9063868 | A | | 3/1997 |

* cited by examiner

*Primary Examiner* — Jue Zhang
(74) *Attorney, Agent, or Firm* — Andrew Wilford

(57) ABSTRACT

The invention relates to a stepping switch comprising vacuum switching tubes. The general inventive concept consists in providing one or more cam disks which have profiled circumferential contours both on the upper or lower face as well as on the lateral face, said contours being in the shape of cams for example, so that the vacuum switching tubes can be actuated by both the profiled circumferential contour of the lateral face as well as by the contour of the upper or lower face.

4 Claims, 3 Drawing Sheets

TAP CHANGER WITH VACUUM SWITCH TUBES

CROSS REFERENCE TO RELATED APPLICATIONS

This application is the US-national stage of PCT application PCT/EP2010/003554 filed 13 Jun. 2010, published 31 Mar. 2011 as WO2011/035825, and claiming the priority of German patent application 102009043171.3 itself filed 26 Sep. 2009.

FIELD OF THE INVENTION

The invention relates to a tap changer with vacuum-switching tubes consisting of a selector for power-free selection of the respective winding tap of the tapped transformer which is to be switched to and a load changeover switch for the actual switching from the connected to the new, preselected winding tap.

BACKGROUND OF THE INVENTION

Tap changers have been in worldwide use in large numbers for many years for uninterrupted switching between different winding taps of tapped transformers. Such tap changers usually consist of a selector for power-free selection of the winding tap of the tapped transformer which is to be switched to and a load changeover switch for the actual switching from the connected to the new, preselected winding tap. The abrupt switching is usually carried out with the assistance of a force storing unit, on the triggering of which a switching shaft is rapidly rotated. The load changeover switch in addition usually comprises switch contacts and resistance contacts. The switch contacts in that case serve for direct connection of the winding tap with the load shunt and the resistance contacts for temporary connection, i.e. bridging-over by means of one or more switch-over resistances.

Such a load changeover switch of a tap changer, which uses vacuum-switching tubes for uninterrupted switching, is known from DE 195 10 809 [U.S. Pat. No. 5,834,717]. In that case, a respective cam disk is provided for each switching element to be actuated and each movement direction of the drive shaft. The edges of the individual cam disks each have a defined profile which departs from a circular shape and by means of which on rotation of the switching shaft individual vacuum-switching tubes or also mechanical contacts are actuated.

In DE 42 31 353 the actuation of the individual vacuum-switching tubes takes place through a switching shaft which is rotatable in both directions and which is rapidly rotated after triggering of a force storage unit. In that case, fixedly arranged on the switching shaft for actuation of the vacuum-switching tubes is a cam disk which has at its edge for each vacuum-switching tube a respective cam formation against which a respective roller, which acts on the actuating lever of the associated vacuum-switching tube, is mechanically urged. The cam formation is here realized in the form of a horizontal annular groove which departs from the circular profile and in which the respective roller mechanically positively engages.

In addition, a load changeover switch operating in accordance with the reactor principle is known from DE 40 11 019 C1, in which the cam disk for actuation of the contacts does not have a profile departing at the annular edge from a circular shape, but possesses on the upper side and lower side thereof grooves with geometrically different shape. A double-sided actuation of different switching elements with a different switching sequence is possible with this known solution.

A disadvantage of these known solutions is the large space requirement of the plurality of cam disks, since a respective separate cam disk is needed for actuation of each individual vacuum-switching tube. This problem is particularly relevant when for realization of the switching sequence a larger number of vacuum-switching tubes per phase is incorporated in the load changeover switch. The available installation space within the load changeover switch is often then no longer sufficient in the known solutions and constructionally disadvantageous compromise solutions have to be adopted.

OBJECT OF THE INVENTION

It is accordingly the object of the invention to provide a tap changer with vacuum-switching tubes of the kind described above in which the one or more cam disks occupy only a small amount of installation space within the load changeover switch notwithstanding a plurality of switch contacts to be actuated.

SUMMARY OF THE INVENTION

According to the invention this object is fulfilled by a tap changer with vacuum-switching tubes with the features of the patent claims.

The general inventive idea of the invention consists in providing one or more cam disks which have not only on the upper side or lower side, but also on the edge profiled annular cam formations, for example in the form of cams, so that electrical contacts, for example vacuum-switching tubes, are actuatable by both the profiled annular cam formation of the edge and the upper side or lower side. According to the invention several regions of the surface of one or more cam disks are thus provided for actuation of different electrical contacts with different switching sequences.

Through the solution in accordance with the invention it is now possible for the first time to actuate a plurality of vacuum-switching tubes when only a small installation space is available, in that the individual rollers, which, for example, co-operate by means of a rocker lever with the vacuum-switching tubes, are brought into engagement with the respectively co-operating cam formation of the cam disk no longer just at the upper side or lower side of the corresponding cam disk or alternatively at the edge thereof, but with a combination of the two sides or even all three sides, thus a combination of upper side, lower side and edge. This has the consequence of a very compact overall mode of construction of the cam disk, a reduction in the components needed and thus a saving of space within the load changeover switch.

BRIEF DESCRIPTION OF THE DRAWING

The invention shall be explained in more detail by way of example in the following on the basis of drawings, in which.

SPECIFIC DESCRIPTION OF THE INVENTION

Figure 1:
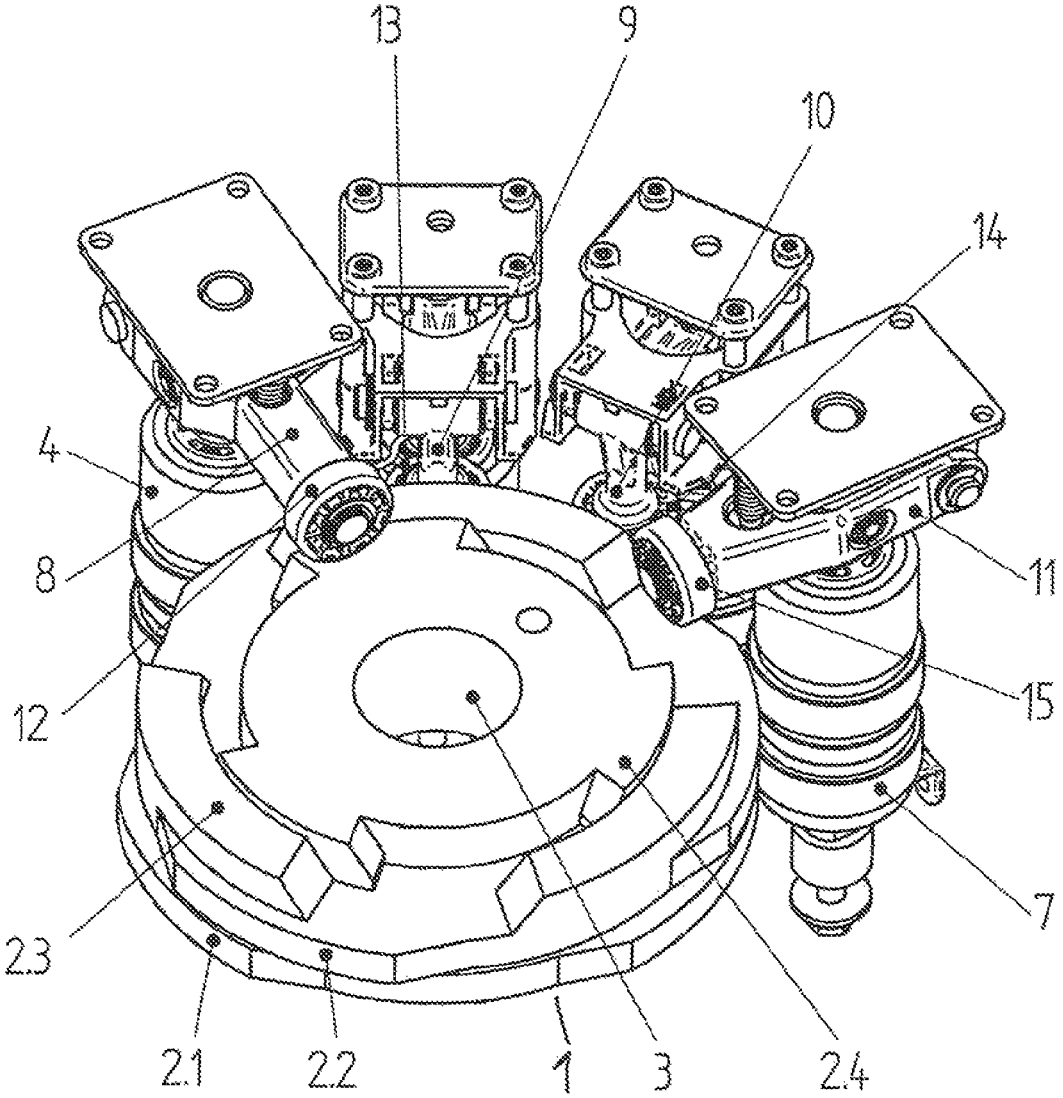
FIG. 1 shows perspective view of a part of a tap changer according to the invention with vacuum-switching tubes.

For reasons of clarity only those parts of a tap changer according to the invention with vacuum-switching tubes that are essential to the invention are illustrated and described in the following in FIG. 1. The description and illustration of features which are known per se and components not relevant to the essence of the invention was dispensed with. Accordingly, FIG. 1 shows a a cam disk 1 with a plurality of cam formations 2.1, 2.2, 2.3 and 2.4 which in their co-operation control the switching sequence in time of a contact system for the switching of a tap changer and are suitable for actuation of a plurality of vacuum-switching tubes. The two cam formations 2.1 and 2.2 are on the edge of the cam disk 1, depart from a circular shape, and engage, with constrained maintenance of contact, respective rollers 13 and 14 connected by way of rocker levers 9 and 10 with respective vacuum-switching tubes 4 and 5 (see FIG. 2). Since the rollers 13 and 14 employed here serve the purpose of engaging the cam formations departing from a circular shape they can also be replaced by other sliding elements with equivalent effect, for example spring-loaded pins. In addition, the width of the edge of the cam formation 1 is used for the purpose of carrying more than only one cam formation. However, it would obviously also be possible to restrict to only one cam formation at the edge.

Figure 2:
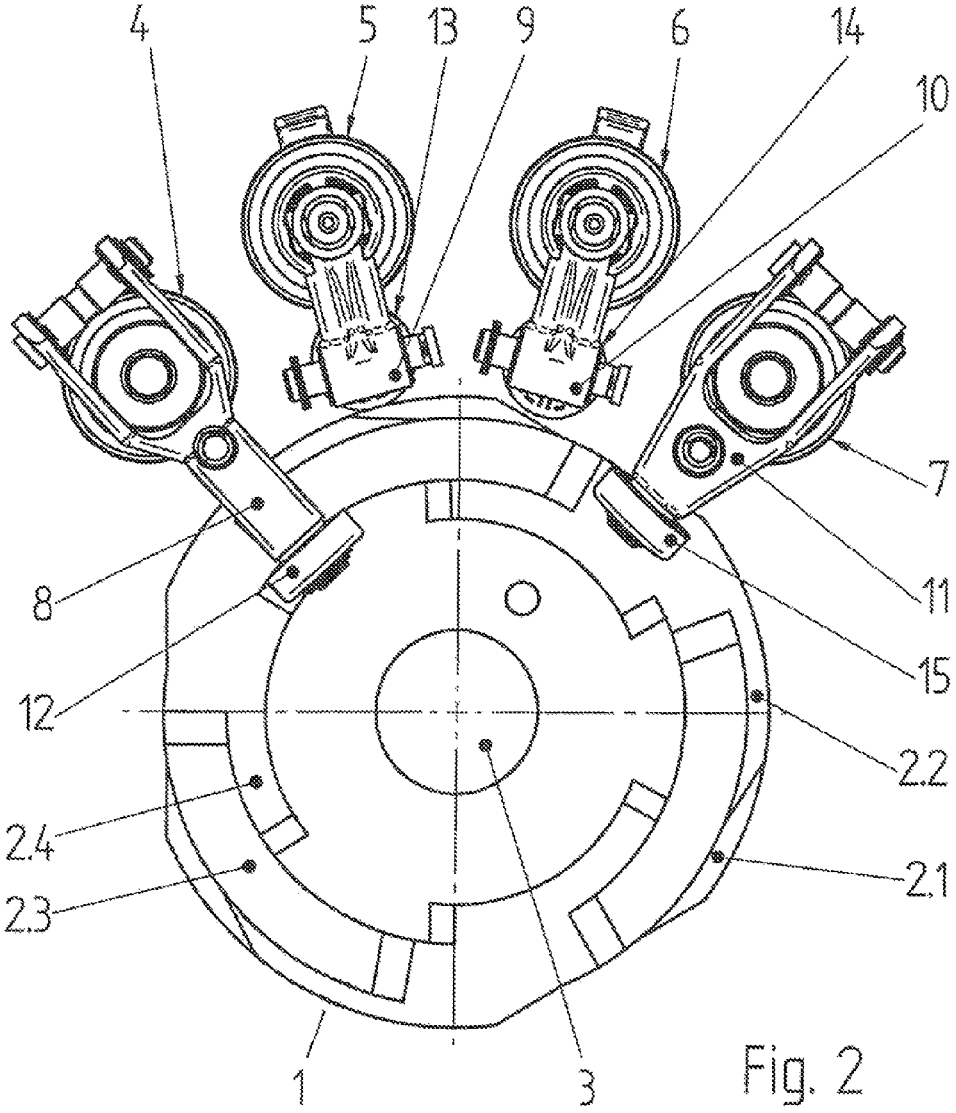
FIG. 2 shows a plan view of a part of a tap changer according to the invention with vacuum-switching tubes.

The function and positioning of the rollers, rocker levers and vacuum-switching tubes are explained in more detail in FIG. 2. Mounted on the upper face of the cam disk 1 are two further cam formations 2.3 and 2.4 that co-operate with respective rollers 12 and 15 carried on respective rocker levers 8 and 11 and operating respective vacuum-switching tubes 4 and 7. In addition, it would also be readily capable of technical realization to mount the cam formations 2.3 and 2.4 on the lower side of the cam disk 1. The height profiling, which is provided on the cam formations 2.3 and 2.4, in the manner of annular cams consists of tracks arranged substantially concentrically with respect to one another. In that case the height of the cam formation 2.4 is somewhat thicker by comparison with that of the cam formation 2.3 so that in the case of rotation of the cam disk 1 neither of the rollers 12 and 15 engaging the height profiles of the corresponding cam formations 2.3 and 2.4 collides with the height profile of the respective other cam formation. In this mode and manner it is also possible to provide on the upper side or lower side of the cam disk 1 more than the two cam formations 2.3 and 2.4 illustrated in FIG. 1.

In the case of the cam disk 1 according to the invention profiled annular cam formations, for example in the form of cams, are provided not only on the upper side or lower side, but also on the edge so that different electrical contacts, for example in the form of vacuum-switching tubes, are actuatable by both the profiled annular cam formation of the edge and the upper or lower side. The annular cam formations at the edge as well as the upper or lower face can also be termed cam tracks. The angle of incidence of the respective cams can be selected within wide limits and extends from a very acute angle to an approximate right angle. It is also possible to form the individual cams with a flowing transition in the manner of waves. Formed centrally in the interior of the substantially rotationally symmetrical cam disk 1 is an opening 3 through which a switching shaft (not illustrated) is guided, which shaft is fixed to the cam disk 1 and rotates the cam disk 1. In summary, FIG. 1 shows a single cam disk 1 provided with a plurality of cam formations 2.1 to 2.4 that enable space-saving actuation of a plurality of vacuum-switching tubes 4 to 7.

It is also conceivable within the scope of the invention to arrange a plurality of cam disks with displacement in the axial direction of the switching shaft (not illustrated), thus one above the other. Profiled cam formations, for example in the form of cam tracks, could then be arranged at each individual cam disk not only on the upper side or lower side, but also on the edge as described and more closely illustrated in FIG. 1 and thus, if required, an even greater number of vacuum-switching tubes could be actuated in simple manner.

FIG. 2 shows a plan view of a part of a tap changer according to the invention with vacuum-switching tubes. The vacuum-switching tubes 4, 5, 6 and 7 are so positioned with respect to the cam disk 1 that they are actuatable in the most space-saving manner possible by the rocker levers 8, 9, 10 and 11 and rollers 12, 13, 14 and 15 co-operating therewith. The rollers 12 and 15 then engage, in the case of rotation of the cam disk 1, the surfaces of the respective annular cam formations 2.3 and 2.4 and actuate, according to the respective changing surface profiles, the respective vacuum-switching tubes 4 or 7. Accordingly, the rollers 13 and 14 then engage, in parallel therewith, the edge cam formations 2.1 and 2.2 that depart from a circular shape, in the manner of cams and actuate the respectively cooperating vacuum-switching tubes 5 and 6.

The cam disk 1 illustrated in FIGS. 1 and 2 is of one-piece construction and with particular preference is made in addition of electrically insulating material. However, in the alternative it is also conceivable for the cam disk 1 to be of multi-part construction, for example in such a manner that each cam disk 2.1 to 2.4 is a separate component which only subsequently to the production process is assembled into a cam disk 1, or the separate components are individually plugged onto the switching shaft (not illustrated).

Figure 3:
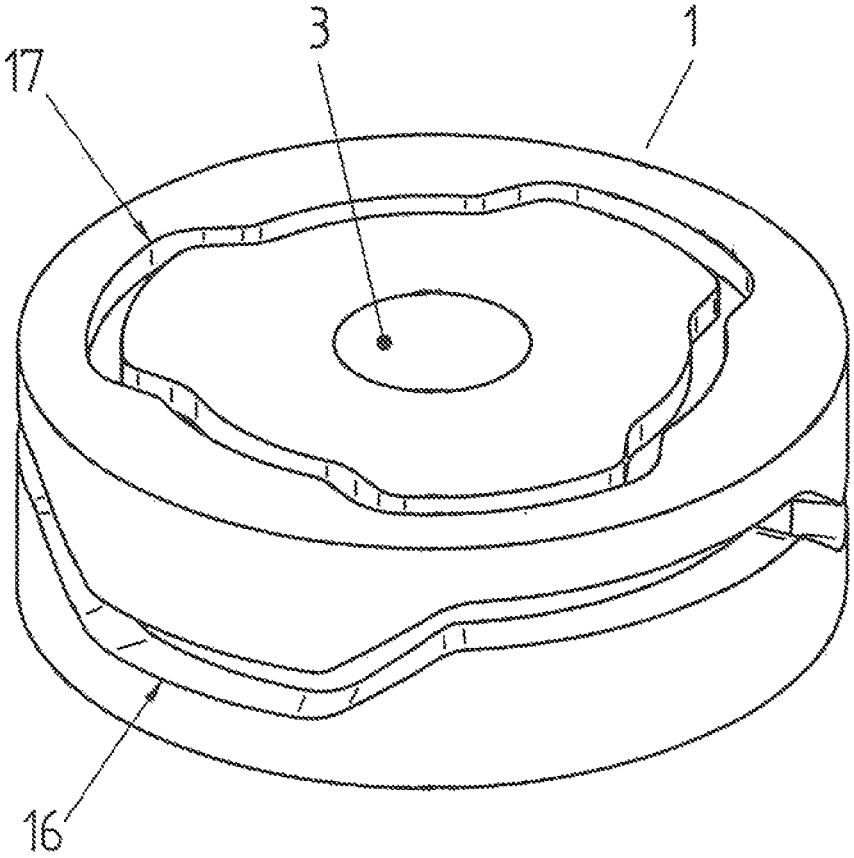
FIG. 3 shows a preferred form of embodiment of a tap changer according to the invention with vacuum-switching tubes.

In contrast to FIGS. 1 and 2, in FIG. 3 the annular profiled cam formations for actuation of the plurality of vacuum-switching tubes are not constructed as cam tracks departing from a circular shape, but as annular grooves 16 and 17 on the upper or lower side as well as the edge and in the profile of which the respective cooperating rollers engage and are guided on rotation of the cam disk 1. Thus, also in FIG. 3 as in accordance with the general inventive idea several regions of the surface of one or more cam disks are provided for actuation of different electrical contacts, such as, for example, vacuum-switching tubes (which are not further illustrated in this FIG. 3), with different switching sequences.

The invention claimed is:

1. A tap changer comprising:

four vacuum tubes;

a cam disk rotatable about an axis and having an annular and radially directed edge and an axially directed end face;

two concentric radially offset and annular cam formations of varying axial depth on the end face;

two axially spaced annular cam formations on the edge of varying radial height or depth;

respective radially shiftable rockers each connected to a respective one of the vacuum tubes and each carrying a roller bearing radially inward on a respective one of the cam formations of the edge; and respective axially shiftable rockers each connected to a respective one of the vacuum tubes and each carrying a roller bearing axially on a respective one of the cam formations of the end face.

2. The tap changer defined in claim 1, wherein the cam formations of the end face axially engage the respective rollers and the cam formations of the edge radially engage the respective rollers.

3. The tap changer defined in claim 1, wherein the cam disk is formed unitarily with the cam formations.

4. The tap changer defined in claim 1, wherein the cam disk is formed as a stack of disks each forming a respective one of the cam formations.

* * * * *